United States Patent [19]

Takei et al.

[11] 4,304,113

[45] Dec. 8, 1981

[54] PROCESS OF MAKING PLATED WIRE FOR REINFORCING RUBBER GOODS

[75] Inventors: Masamitsu Takei; Kunihiko Kataoka, both of Chiba; Yoshitaka Udagawa, Machida; Shunichi Harada; Kozo Tsunoyama, both of Chiba, all of Japan

[73] Assignees: Kawasaki Steel Corporation, Kobe; Kawatetsu Wire Products Company Ltd.; The Yokohama Rubber Company Ltd., both of Tokyo, all of Japan

[21] Appl. No.: 73,514

[22] Filed: Sep. 7, 1979

[51] Int. Cl.[3] ..... B21C 43/00; B21C 1/00

[52] U.S. Cl. ..... 72/39; 72/47; 428/389; 428/658

[58] Field of Search ..... 72/39, 47; 134/41, 15; 204/35 R, 37 R; 428/381, 389, 658, 677

[56] References Cited

U.S. PATENT DOCUMENTS

| | | | |
|---|---|---|---|
| 2,002,261 | 5/1935 | Domm | 428/658 X |
| 2,870,526 | 1/1959 | Adler | 428/658 |
| 2,939,207 | 6/1960 | Adler | 428/658 X |
| 3,749,558 | 7/1973 | Dillenschneider | 428/675 |
| 3,762,883 | 10/1973 | Shepard et al. | 428/658 |
| 3,936,536 | 2/1976 | Brock | 428/389 |
| 3,986,378 | 10/1976 | Alekhin et al. | 72/39 X |
| 4,143,209 | 3/1979 | Gerspacher | 72/47 X |

*Primary Examiner*—Ervin M. Combs

*Attorney, Agent, or Firm*—Balogh, Osann, Kramer, Dvorak, Genova & Traub

[57] ABSTRACT

An improved wire with an excellent adhesion with rubber is disclosed for reinforcing rubber goods, made by a diffusion process wherein oxides formed on the surface of plated metal during diffusion are removed before drawing.

5 Claims, 14 Drawing Figures o——o brass plated steel cords by conventional diffusion process

Δ----Δ brass plated steel cords by alloying, for comparison

Both with twisted strands of 3 (0.2 mm dia.) plus 6 (0.38 mm dia.)

Manufacturing condition: plating alloy ratio, Cy 65 % amount of plated metal, 6.4 g/kg, diffusing at 575 °C for 10 seconds o——o brass plated steel cords by conventional diffusion process Δ----Δ brass plated steel cords by alloying, for comparison Both with twisted strands of 7 times 4 (0.175mm dia.)

Manufacturing condition: plating alloy ratio, Cu 66% amount of plated metal, 6.5g/kg, diffusing at 575°C for 10 seconds o----o brass plated steel cords by conventional diffusion process ●——● brass plated steel cords of the invention Both with twisted strands of 3 + 6

○-----○ brass plated steel cords by conventional diffusion process

●——● brass plated steel cords of the invention

Both with twisted strands of 3 + 6

PROCESS OF MAKING PLATED WIRE FOR REINFORCING RUBBER GOODS

BACKGROUND OF THE INVENTION

1. Field of the Invention

This invention relates to a wire for reinforcing rubber goods, and more particularly to provision of a brass plated wire of the aforesaid type made by a thermal diffusion process and having a highly improved adhesion with rubber.

2. Description of the Prior Art

Recently, with the progress of various composite materials, research and development of materials having new physical properties have been carried out. Especially, among metallic materials having a very high strength and a high rigidity, wires such as steel wires, steel stranded wires, and steel cores having flexible and resilient rubber adhered thereto have been developed as new materials having excellent static and dynamic elongation and flexing fatigue resistivity, these new materials have made a remarkable contribution to automobile rubber tires, rubber hoses, and other industrial products as well as in other fields. Generally speaking, there are two basic methods for adhering rubber onto the surface of a metal; i.e., a process for applying chlorinated rubber, cyclized rubber, synthetic resin or isocyanates on the surface of the metal for facilitating the adhesion of rubber thereto, and another process for plating brass or other suitable material on the surface of the metal for improving the adhesion of rubber thereto. The latter method is better in heat-resisting adhesion and flexure resisting properties than the former method, so that it is well known that the latter method has been generally used.

For high-level requirements as represented by those necessitated by high-speed and other advanced performance of recent automobiles, however, the adhesion of the conventional brass plated steel cords with rubber is insufficient, and there is a demand for further reduction of variation in adhesion. To meet such demand, various trials have been made, such as a process of applying an additional adhesive liquid on the brass plated steel cords and a process using a modified formula of compounding agents for rubber. Those recent trials, however, have not succeeded yet in providing satisfactory adhesion of a metal with rubber through a simple process.

SUMMARY OF THE INVENTION

In contrast to the aforesaid trials for improving the adhesion of brass plated steel cords with rubber from the standpoint of the adhesive or rubber, the inventors have tried to improve the adhesion from the standpoint of the brass plated steel cords. Thus, the invention relates to the result of development on a further improvement of the adhesion of metal wires with rubber, especially such adhesion of steel wires and steel cords to be embedded inside the rubber goods for reinforcement thereof.

As regards the prior art for plating brass on the surface of steel wires, two different processes have been used; namely, a process of simultaneously effecting electric plating of copper and zinc by using a cyanic bath (to be referred to as "alloying process", hereinafter) and the aforesaid diffusion process. The alloying process has a drawback of using the cyanic bath which can be a cause of pollution and other environmental hygienic problems. While the diffusion process is slightly complicated, because the diffusion process comprises steps of electrically plating copper by using a copper pyrophosphate bath or a copper sulfate bath, electrically plating zinc by using a zinc sulfate bath or a zinc chloride bath, and thereafter diffusing by heating. Despite such slight complicatedness, however, the diffusion process has its relative importance increased, mainly due to an improvement of copper plating techniques without using any cyanic material for removing the environmental hygienic problems and the ease of obtaining homogeneity of the plated metal by controlling the plating alloy ratio ($Cu/(Cu+Zn)\times 100\%$, to be referred to as "plating alloy ratio", hereinafter), which ratio greatly affects the adhesion of the wires with rubber, the amount of the metal plated, and the diffusing conditions such as temperature and time.

With the diffusion process, in addition to the generally known plating alloy ratio of the brass layer and the amount of the plated brass, it has been believed that an optimization of the diffusing conditions is necessary by heating at a temperature higher than 500° C., preferably higher than 550° C., for 5 seconds or more, for providing a brass plated steel cord having a good adhesion with rubber.

What is meant by the aforesaid adhesion with rubber has been just an initial adhesion (i.e., an adhesion with rubber as measured by the test method of ASTM D2229-73, under commonly-used vulcanizing conditions for rubber goods, more particularly 145° C. for 45 minutes or at 160° C. for 20 minutes), but brass plated steel cords for recently developed automobile tires required multi-phased adhesion with rubber which includes, in addition to the initial adhesion, a water-durable adhesion to be evaluated after keeping the rubber at 25° C. with 100% humidity for a predetermined number of days by the same method as the initial adhesion test so as to check the influence of water and humidity on the adhesion between the rubber and the steel cords, and also a heat-aging resisting adhesion to be evaluated after heating for a considerably long period of time by the test method of ASTM D2229-73 so as to check the deterioration of the adhesion between the rubber and the steel cords. The water-durable adhesion and the heat-aging resisting adhesion are considered to be of special importance, and there is an increasing demand for brass plated steel cords which are excellent in such adhesion.

An analysis of the adhesion of brass plated steel cords made by a conventional diffusion process with rubber showed that, if a metallic salt of an organic acid, such as cobalt naphthenate or cobalt stearate, was added in a rubber as a compounding agent for enhancing the adhesion with steel cords, nearly satisfactory initial adhesion and water-durable adhesion could be achieved, but the heat-aging resisting adhesion obtained by using such compounding agent was still considerably below a satisfactory level. Such adhesions are evaluated by the aforesaid methods, and in addition to pull-out forces, special importance is given to a rubber coverage of the brass plated steel cords by rubber remaining on the cords after being pulled out (i.e., a coverage expressed in a percentage of rubber covered and rubber-removed areas, to be referred to as "rubber adhesion rate", hereinafter).

The present invention is based on a presumption that oxides, mostly zinc oxides, existing on the brass plated surface of metal wires may hamper the heat-aging resisting adhesion of the wires made by the diffusion process, and the inventors have found that removal of the zinc oxide film portion from the pre-drawing brass plated wires after the brass plating results in a considerable improvement of the heat-aging resisting adhesion.

Therefore, an object of the present invention is to overcome the aforesaid shortcomings of the processes of the prior art by providing an improved wire having excellent adhesion with rubber for reinforcing rubber goods, which wire is made by process comprising steps of plating copper on the surface of a metallic wire, plating zinc on said copper, diffusing said metals thus plated such as zinc into copper layer by heating, removing oxides formed during said diffusion on brass layer by dissolution thereof, and then drawing the wire thus plated.

BRIEF DESCRIPTION OF THE DRAWING

For a better understanding of the invention, reference is made to the accompanying drawings, in which.

Figure 1A:
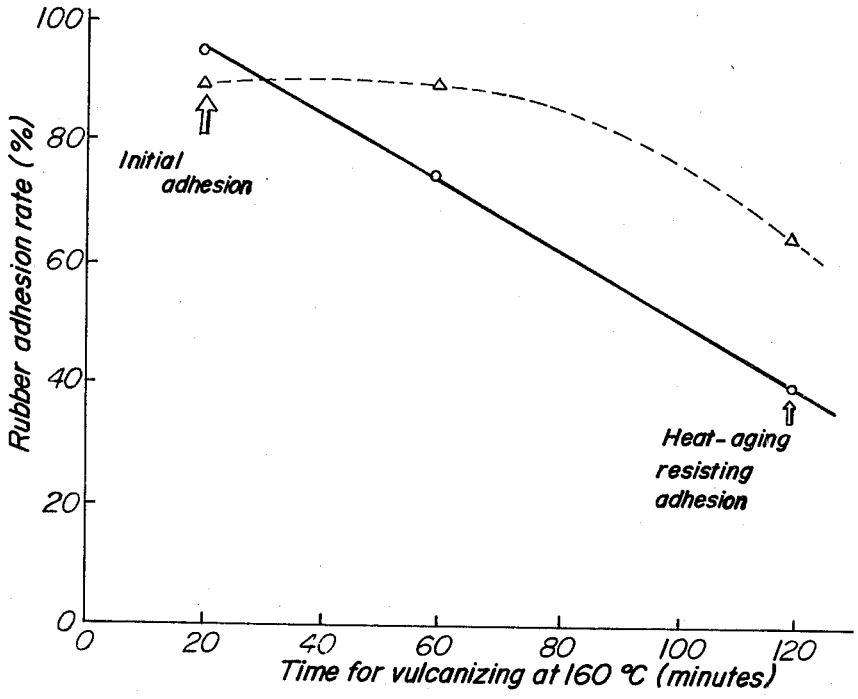
FIGS. 1*a* and 1*b* are graphs showing the initial adhesion and heat-aging resisting adhesion of brass plated steel cords made by a conventional diffusion process with rubber, as compared with those of similar cords made by an alloying process.
Figure 1B:
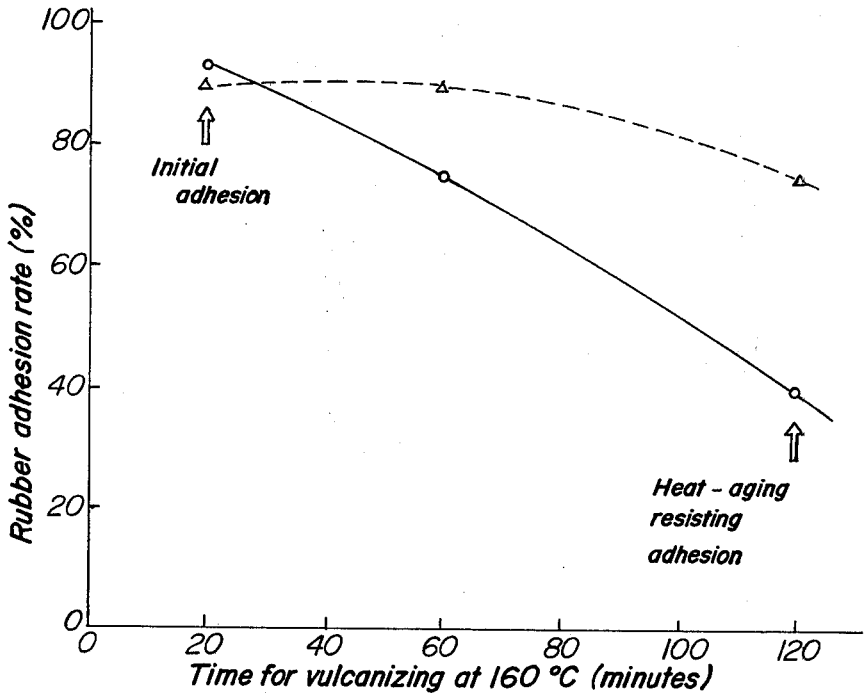
Figure 2A:
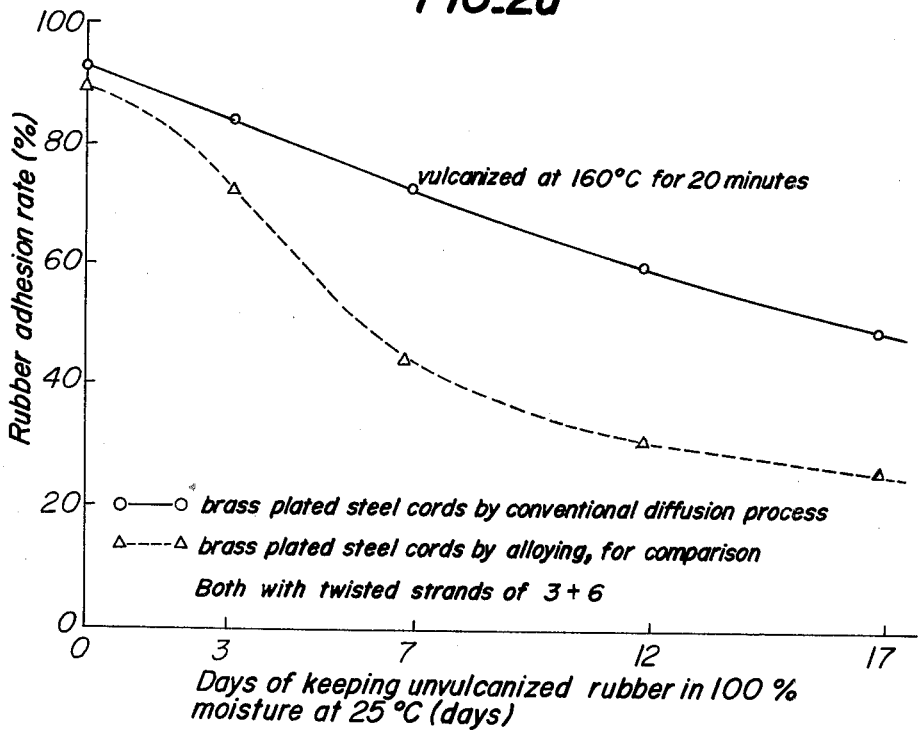
FIGS. 2*a* and 2*b* are similar graphs showing the water-durable adhesion of the brass plated cords, in comparison with the outcome of an alloying process.
Figure 2B:
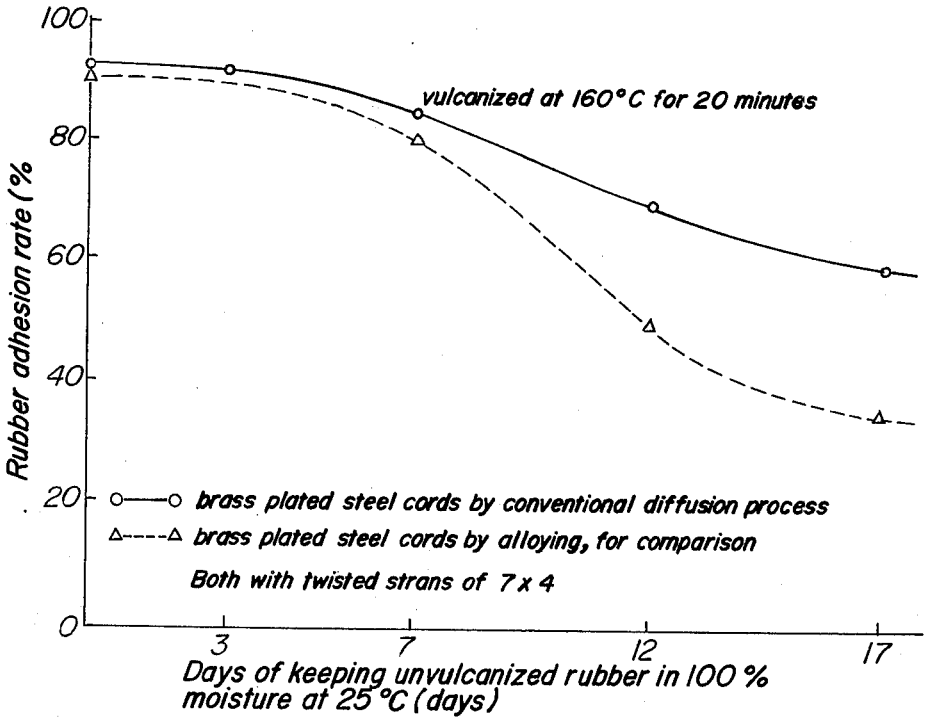

In the drawing, 1 is a steel wire, 2 is an acid washing vessel, 3 is a water washing vessel, 4 is an alkaline washing vessel, 5 is a copper plating vessel, 6 is a zinc plating vessel, 7 is a drier, 8 is an electric heater, and 9 is an after-treatment vessel.

DESCRIPTION OF THE PREFERRED EMBODIMENT

Exemplary results of analyses of rubber adhesion rates are shown in FIGS. 1*a*, 1*b* and FIGS. 2*a*, 2*b*. For comparison, brass plated steel cords may by the alloying process available in the market were tested simultaneously, and the results are also shown in the figures. Furthermore, in order to check whether the trends shown in the figures are due to the manufacturing conditions or the diffusion process or whether the conventional diffusion process provides any solution to the problem of unsatisfactory heat-aging resisting adhesion, the initial adhesion, the water-durable adhesion and the heat-aging resisting adhesion were evaluated under various combinations of the plating alloy ratio, the amount of the plated metal, and the diffusion temperature. As a result, some products showed a slightly improved adhesion by selecting a suitable manufacturing conditions, but it became apparent that a complete solution of the aforesaid problem of insufficient heat-aging resisting adhesion cannot be achieved within the framework of the conventional diffusion process. A part of such tests is shown in FIG. 3 through FIG. 5.

Figure 3:
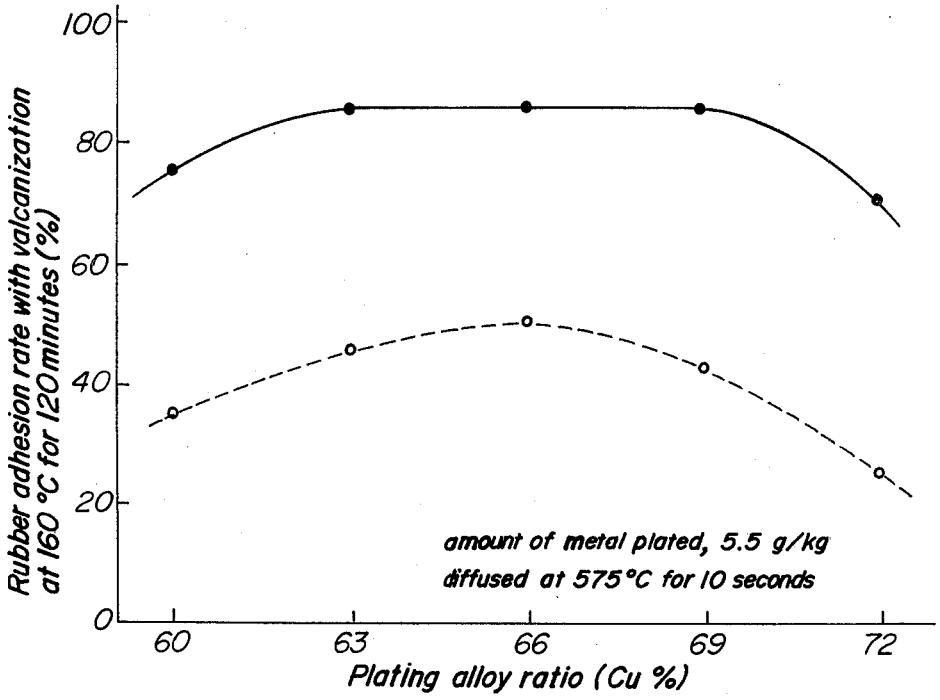
FIG. 3 is a graph showing the variation of the heat-aging resisting adhesion of brass plated cords made by a diffusion process with the change of plating alloy ratio.
Figure 4:
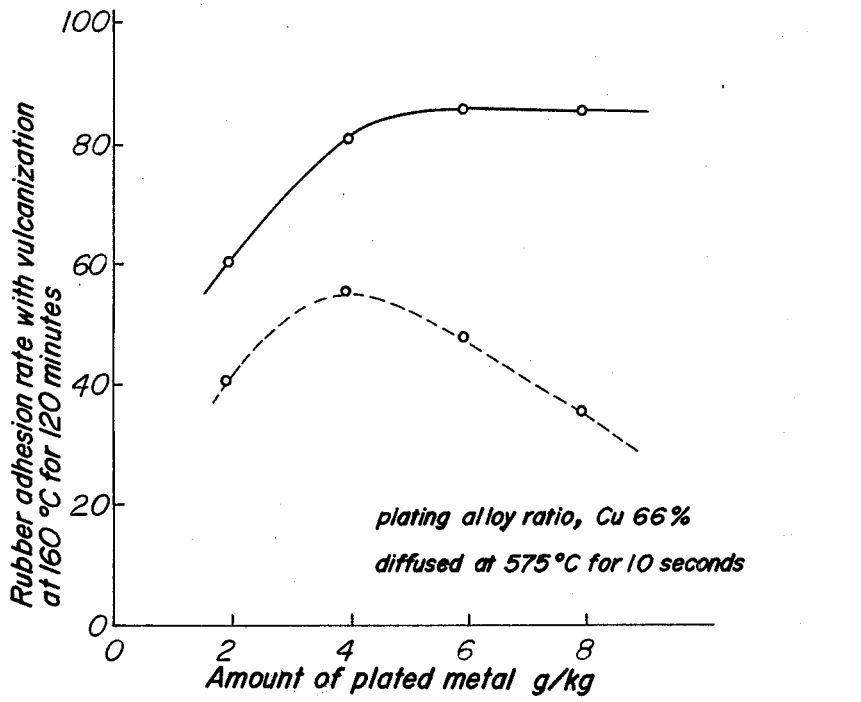
FIG. 4 is a graph showing the effects of the amount of a plated metal on the heat-aging resisting adhesion.
Figure 5:
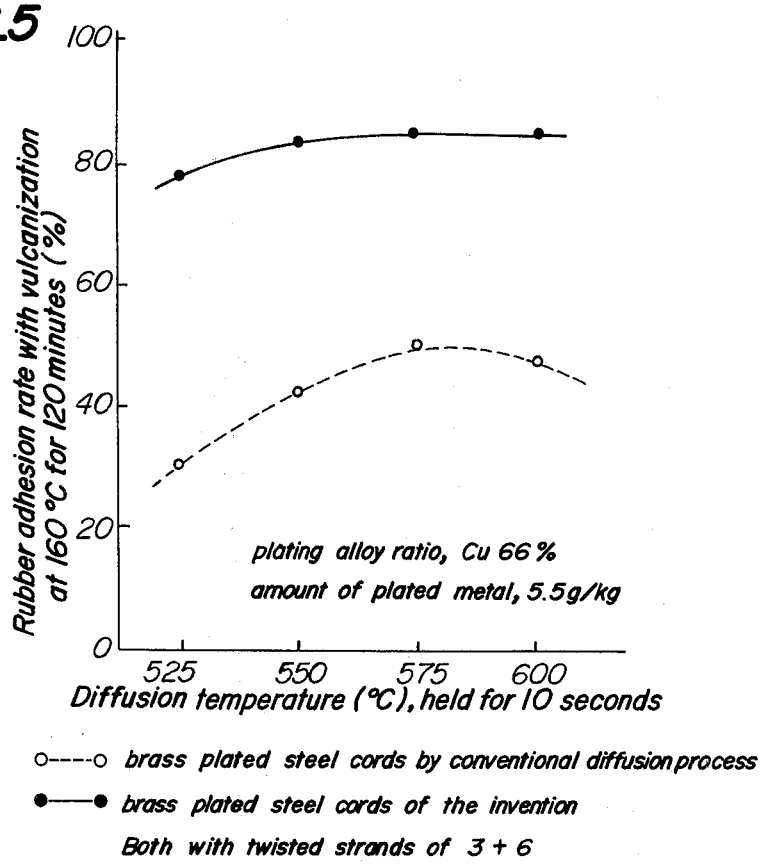
FIG. 5 is a graph showing the effects of the temperature of diffusion treatment on the heat-aging resisting adhesion.

FIG. 3 shows the relationship between the plating alloy ratio and the heat-aging resisting adhesion of the brass plated steel cords, FIG. 4 shows the relationship between the amount of the plated metal and the heat-aging resisting adhesion of the brass plated steel cords, and FIG. 5 shows the relationship between the diffusing condition and the heat-aging resisting adhesion of the brass plated steel cords, respectively.

Therefore, it is an object of the present invention to improve the heat-aging resisting adhesion of the brass plated wires with rubber, which heat-aging resisting adhesion is a critical shortcoming of the conventional diffusion process, in an economical and easily practicable manner on an industrial basis.

In order to clarify the reasons for inability of the conventional diffusion process in improving the heat-aging resisting adhesion, the structure of the plated brass layer was closely investigated both on brass plated wires after the diffusion treatment (to be referred to as "brass plated wire", hereinafter) and on wires after drawing, by suitable analyzing devices, such as an ion microanalyzer and an X-ray diffraction device.

Figure 6A:
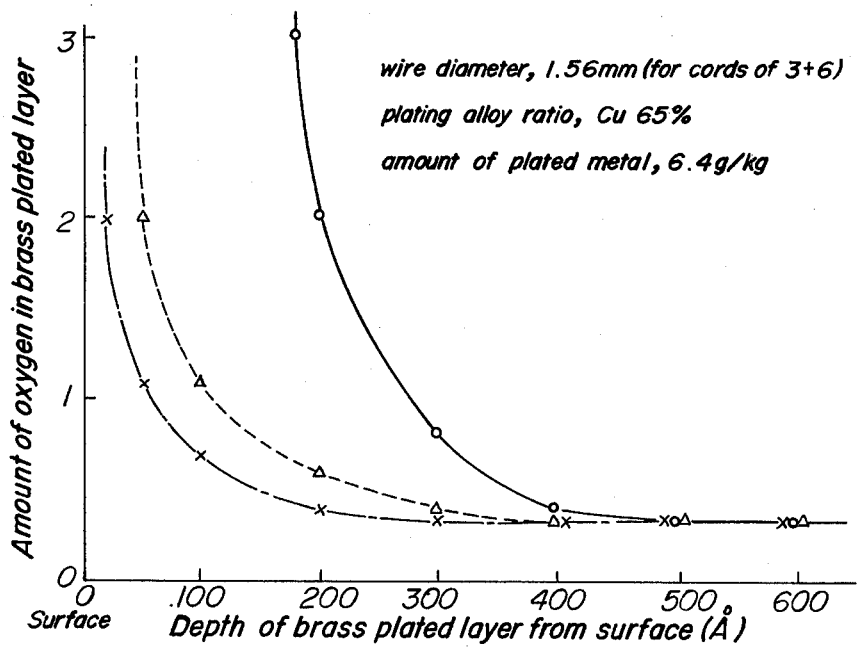
FIGS. 6*a* and 6*b* are graphs showing the amounts of oxygen and zinc, respectively, as measured at different depths of plated brass layers of steel cords made by a conventional diffusion process.
Figure 6B:
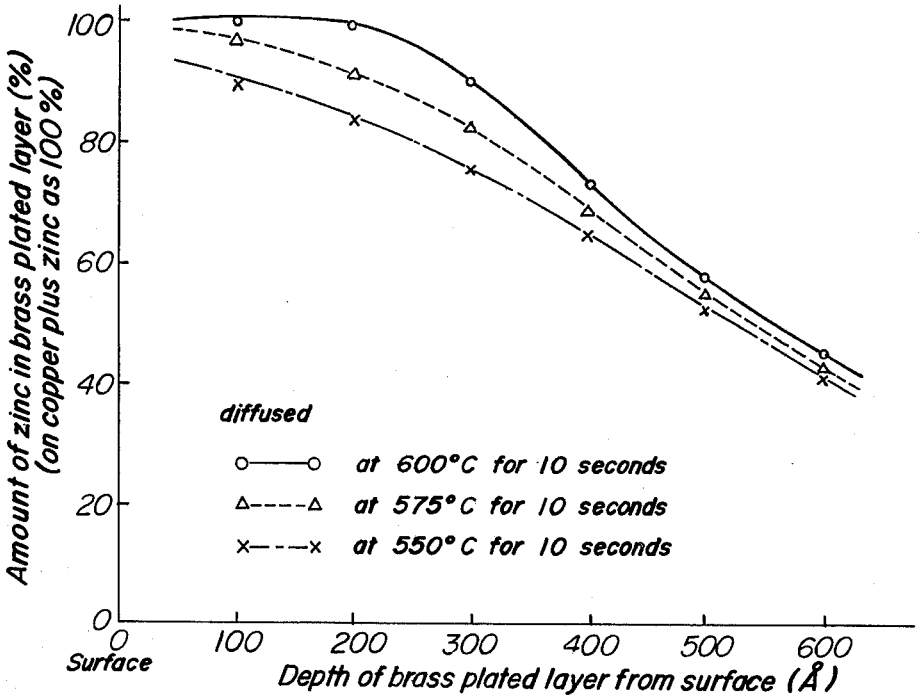
Figure 7A:
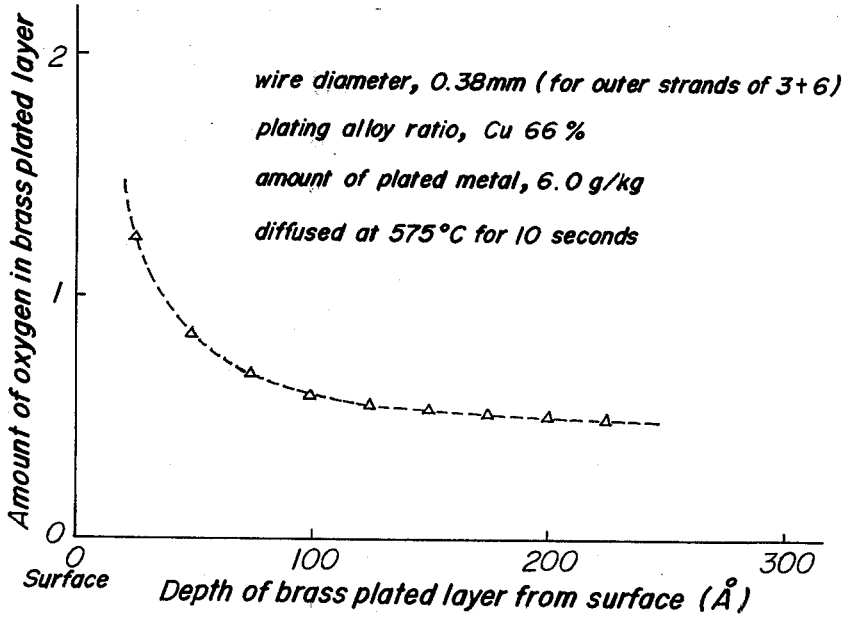
FIGS. 7*a* and 7*b* are similar graphs, for steel wires made by the process according to the present invention.
Figure 7B:
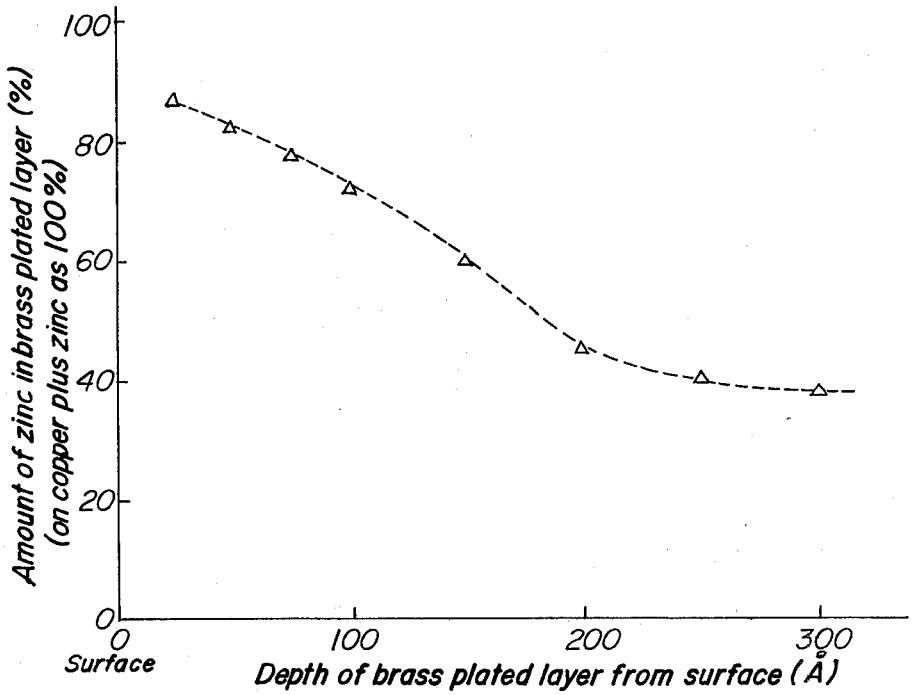

As a result, a new fact was found that there was an oxide film, which was presumed as a zinc oxide (ZnO) film, on the surface of the brass plated wire after the diffusion treatment by heating and a layer with a high concentration of zinc existed under the oxide film, and a considerable amount of the oxide film remained even after the drawing despite partial movement of the oxide film during the drawing operation. FIG. 6 and FIG. 7 show the results of the measurement of the amount of oxygen in the thickness direction of the plated layer and the amount of zinc in the plated brass layer as measured by an ion microprove mass analyzer (made by Applied Research Laboratories), wherein FIG. 6 shows data on brass plated wires and FIG. 7 shows data on drawn wires. The figures show that large amounts of oxygen and zinc exist on the surfaces of the plated brass.

In the measurement of oxygen, primary beams were radiated by using $N_2^+$ at an accelerating voltage of 20 kV and a current of 10 mA and the measurement was taken with a beam diameter of 10 $\mu$m in an irradiated area of $100\times120$ $\mu$m, while the alloy ratio was measured by using $O_2^+$ at an accelerating voltage of 20 kV and a current of 10 mA and the measurement was taken with a beam diameter of 10 $\mu$m in a irradiated area of $100\times120$ $\mu$m.

The amount of zinc oxide was measured by using an X-ray diffraction device (made by Rigaku Denki with a trade name of Rotaflex), both on the brass plated wires and the drawn wires. The following table shows an example of the measured results, and the presence of zinc oxide (ZnO) crystalline structure was confirmed.

TABLE 1

| | Brass plated wire (the wire diffused at 575° C. for 10 seconds, as shown in FIG. 6) | Drawn wire, as drawn from the brass plated wire of the left column |
|---|---|---|
| Peak height of ZnO (101) in mm | 53.0 | 6.5 |

In the measurement of the brass plated wires, CrKα rays were used at a secondary voltage of 45 kV and a current of 200 mA with a scale range of 1,000 cps, while the measurement of the drawn wires was carried out by using CrKα rays at a secondary voltage of 45 kV and a current of 200 mA with a scale range of 200 cps.

Based on such findings, it was inferred that the oxides existing on the surface of the plated brass, mainly consisting of zinc oxide, may cause detrimental effects and hamper the heat-aging resisting adhesion of the wire made by the diffusion process. Furthermore, when the zinc oxide film portion of the brass plated wire was removed by dissolving and similar tests were carried out after the removal, an entirely new fact was found that the brass plated wires drawn from the thus treated brass plated wires had a remarkably improved heat-aging resisting adhesion.

A chemical solution for dissolving and removing the aforesaid oxide layer should be capable of easily and selectively dissolving the oxide film, mainly consisting of zinc oxide, formed on the plated brass surface by the diffusion process, while preferably minimizing dissolution of the plated brass layer underneath the oxide film and causing no change in the quality of the brass layer. Besides, the dissolving power of the solution should be easily controllable, for instance, by suitably selecting the concentration and temperature of the solution and the duration of immersing the wire in the solution, in addition to the selection of a suitable kind of the solution.

A chemical solution meeting the aforesaid requirements is, for instance, an aqueous solution of an inorganic acid, such as hydrochloric acid, nitric acid, sulfuric acid, phosphoric acid, or chromic anhydride; an aqueous solution of an organic acid, such as formic acid, oxalic acid, citric acid, or acetic acid; an aqueous solution of an inorganic alkali metal salt, such as sodium hydroxide, or potassium hydroxide; a mixture of the aforesaid aqueous solutions; or any one of the aforesaid solutions added with a salt, such as sodium sulfate, sodium borate, sodium carbonate, potassium chloride, potassium dihydrogen phosphate, ammonium sulfate, or ammonium chloride.

The inventors studied various methods for removing the aforesaid oxides, in addition to the aforesaid method using a dissolving solution, but the methods which do not use any dissolving solution proved to be unsuitable due to the following reasons.

(1) Physical grinding of the brass plated wires has shortcoming in that uniform removal of oxides is difficult to achieve, and uniform products cannot be produced.

(2) Theoretically, non-oxidizing thermal diffusion may be considered for avoiding the formation of oxides on the surface of the plated metal, but perfect adjustment of the atmosphere is generally difficult to achieve in practice, and even if technical problems of preventing quality of changes in the zinc surface could be solved, there is a shortcoming that the equipments and actual treatments for such non-oxidizing thermal diffusion are too costly.

(3) The aforesaid treatment with the dissolving solution could be applied to brass plated steel cords after drawing the brass plated wires and twisting the thus drawn wires, but with the twisted wire cords, uniform removal of the oxides is difficult to achieve and drying after the removal of oxide is difficult, so that such treatment on the twisted wire cords is not practical.

(4) The removal of the oxides by dissolution could be considered during the drawing operation, but such oxide removing operation in the drawing step is difficult to practice due to the need of high-speed treatment and drying thereafter.

It is noted that an example of treating brass plated steel cords as a pretreatment for applying an adhesive is disclosed in the prior art, but with the present invention, excellent results can be achieved without using any adhesive as such.

An example of devices for effective dissolution and removal of oxides formed on the surface of plated brass in a diffusion process, according to the present invention, will now be explained.

Figure 8:
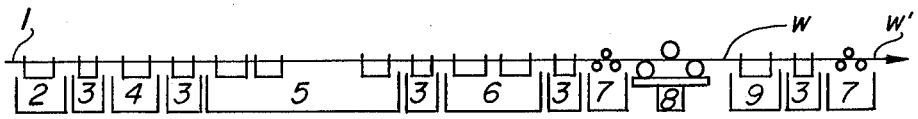
FIG. 8 is an explanatory diagram of a method for making brass plated steel wires by a diffusion process.

FIG. 8 shows a flow chart of a diffusion process for brass plating on the surface of steel wires. According to a diffusion process of prior art, a steel wire is pre-treated by an acid washing vessel 2, a water washing vessel 3, and an alkaline washing vessel 4, and then copper plated and zinc plated in a copper plating vessel 5 and a zinc plating vessel 6, respectively, and further processed through a drier 7 and electric heater 8 for diffusion before being taken up as a brass plated wire w. According to the present invention, after being diffused, the dried wire is passed through an after-treatment vessel 9 for effecting the necessary dissolution of the wire surface for removing oxides, so as to produce an oxide-removed brass plated wire w'.

The brass plated wire w' thus prepared is then fed into a drawing step (not shown), and the brass plated wires are used for reinforcing rubber goods with twisting for forming a brass plated steel cords or without any twisting. The steps for drawing and succeeding treatments thereafter can be the same as those of conventional processes, and the shape of the cross section of the brass plated wires thus formed and the twisted structure of the cords formed with the thus produced wires can be suitably selected so as to meet specific requirements of individual utilizations.

The effects of improving the heat-aging resisting adhesion of brass plated wires formed by the diffusion process and by the dissolution removal of surface oxide films before drawing according to the present invention and similar effects of steel cords made by twisting wires thus formed will now be described in further detail, by referring to examples.

EXAMPLE 1

Brass plating was carried out on a steel wire of 1.56 mm diameter by a diffusion process under the following conditions.

Plating alloy ratio: 65% by weight (the same for alloy ingredient percentages, hereinafter) of copper (Cu), and the remainder of zinc (Zn)

Amount of metal plated: 6.4 g/kg (weight of plated metal in grams per 1 kg of the elementary wire)

Diffusion condition: 575° C. for 10 seconds

The brass plated wire thus made was treated by the process according to the present invention under the following conditions.

Figure 9A:
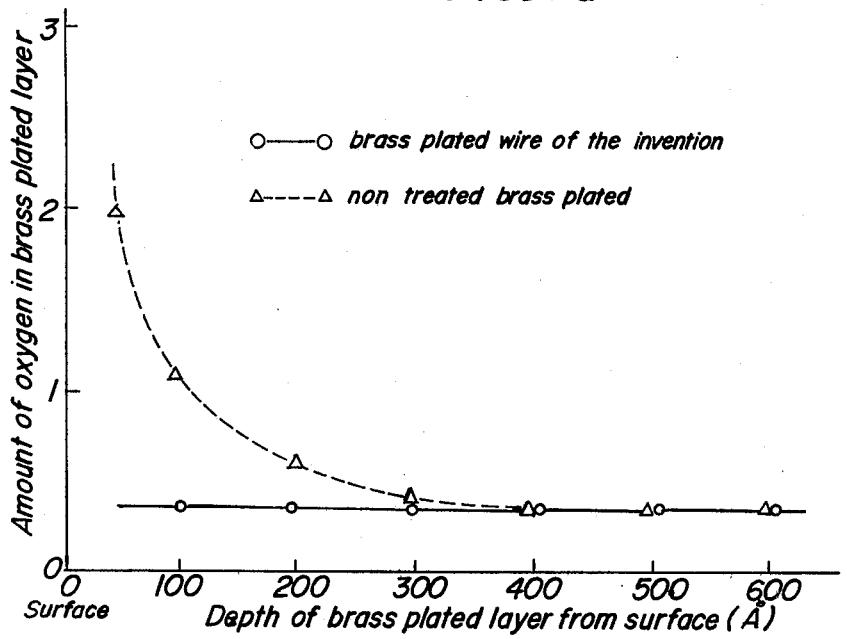
FIGS. 9*a* and 9*b* are graphs showing the amounts of oxygen and zinc, respectively, as measured at different depths of plated brass layers of brass plated wires made by a diffusion process, both before and after oxide removing treatment by dissolution.
Figure 9B:
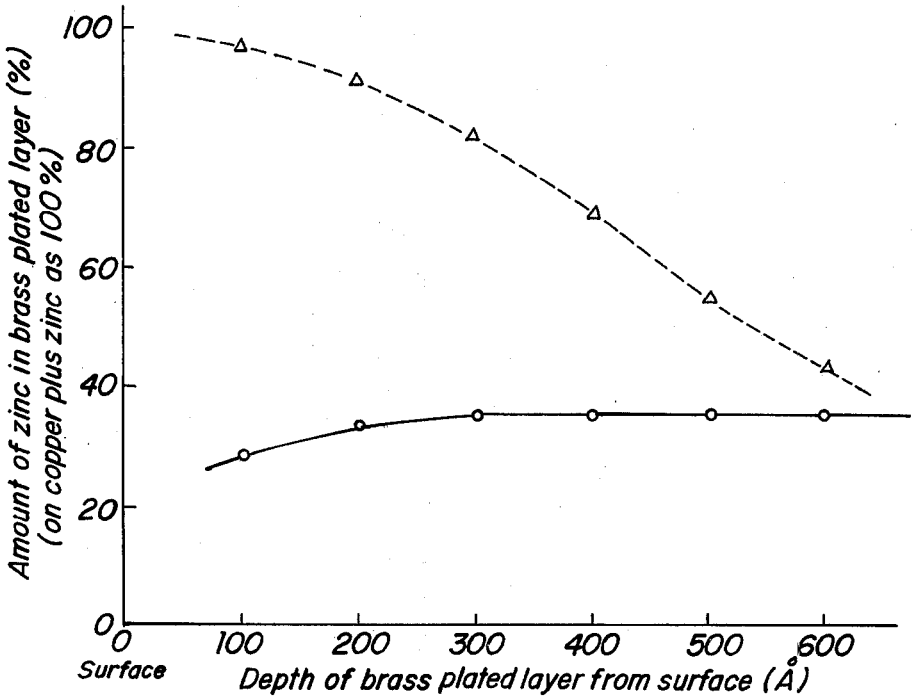

Treating liquid: aqueous solution of phosphoric acid
Concentration of solution: 25% by volume (the same for percent concentration of solution, hereinfter)
Temperature of the solution: 60° C.
Treating time: 2 seconds FIG. 9 shows the plating alloy ratio and the amount of oxygen both in the brass plated wires thus treated by the process of the present invention and in the brass plated wires without the treatment of the invention (to be referred to as "non-treated brass plated wires", hereinafter). The amount of oxygen and the alloy ratio in the direction of the thickness of the plated metal shown in the figure were measured by the aforesaid ion microanalyzer, and very large differences of the amount of oxygen and the amount of zinc in the plated brass layer were noted between the non-treated brass plated wires and the brass plated wires treated by the process of the invention.

The measurements of the amount of zinc oxide (ZnO) by the X-ray diffraction device in the aforesaid manner showed that the peak value for measured curve of ZnO (101) of the non-treated brass plated wire was 55.0 mm, while the corresponding peak value for measured curve of ZnO (101) of the brass coated wire treated by the process of the invention was 0.0 mm or the absence of ZnO was confirmed.

Brass plated steel cords with a twisted strand structure of 3 elementary wires of 0.20 mm diameter plus 6 elementary wires of 0.38 mm diameter (to be referred to as "3+6", hereinafter) were made by using the non-treated brass plated wires and by using the brass plated wires treated by the process of the invention, and the initial adhesion, the heat-aging resisting adhesion and the water-durable adhesion of those cords were tested by using the four kinds of rubbers of the following table 2. The results are shown in other following tables 2 and 3. The test method was according to the aforesaid ASTM D2229-73, and the evaluation was expressed in terms of the pull-out forces and the rubber adhesion rates, and the "treated goods" stand for the brass plated steel cords made by using the brass plated wires treated by the process of the invention, while the "non-treated goods" stand for the brass plated steel cords made by using the non-treated brass plated wires, for the purpose of identification.

As apparent from those tables, it is apparent that, in comparison with the non-treated goods, the goods treated by the process of the invention have a remarkably improved heat-aging resisting adhesion, without deteriorating the initial adhesion and the water-durable adhesion.

TABLE 2

Compounding Agents and Composition of Rubbers Used

| Ingredients | Rubber A | Rubber B | Rubber C | Rubber D |
|---|---|---|---|---|
| | Unit: parts by weight Kinds of rubber | | | |
| Natural rubber | 100 | 100 | 100 | 70 |
| SBR 1500 | — | — | — | 30 |
| Carbon black | 50 | 50 | 50 | 50 |
| Zinc oxide | 5 | 5 | 5 | 5 |
| Stearic acid | 2 | 2 | 2 | 2 |
| Petrolic softener | 5 | 5 | 5 | 5 |
| Antioxidant (D) | 1 | 1 | 1 | 1 |

TABLE 2-continued

Compounding Agents and Composition of Rubbers Used

| Ingredients | Rubber A | Rubber B | Rubber C | Rubber D |
|---|---|---|---|---|
| | Unit: parts by weight Kinds of rubber | | | |
| Cobalt naphthenate | — | 2.5 | — | 2.5 |
| Cobalt stearate | — | — | 2.5 | — |
| Vulcanization accelerator (NOBS) | 1.5 | 1.5 | 1.5 | 1.5 |
| Sulfur | 4 | 4 | 4 | 4 |

TABLE 3

Initial Adhesion and Heat-aging Resisting Adhesion (shown in pull-out force and rubber adhesion rate)

| Kind of rubber | Sample | 160° C. for 20 minutes (kg) | 160° C. for 20 minutes (%) | 160° C. for 60 minutes (kg) | 160° C. for 60 minutes (%) | 160° C. for 120 minutes (kg) | 160° C. for 120 minutes (%) |
|---|---|---|---|---|---|---|---|
| | | Vulcanizing condition | | | | | |
| Rubber A | Treated goods | 138 | 90 | 90 | 85 | 75 | 75 |
| | Non-treated goods | 128 | 90 | 81 | 70 | 65 | 45 |
| Rubber B | Treated goods | 145 | 95 | 102 | 95 | 89 | 85 |
| | Non-treated goods | 139 | 95 | 94 | 80 | 73 | 40 |
| Rubber C | Treated goods | 142 | 95 | 98 | 95 | 86 | 85 |
| | Non-treated goods | 138 | 95 | 89 | 75 | 70 | 35 |
| Rubber D | Treated goods | 140 | 95 | 92 | 95 | 81 | 85 |
| | Non-treated goods | 127 | 95 | 85 | 75 | 66 | 35 |

TABLE 4

Water-durable Adhesion (shown in rubber adhesion rate)

| Kind of rubber | Sample | 0 day | 3 days | 7 days | 12 days | 17 days |
|---|---|---|---|---|---|---|
| | | Holding days | | | | |
| Rubber B | Treated goods | 95% | 85% | 77.5% | 70% | 65% |
| | Non-treated goods | 95% | 85% | 75% | 65% | 55% |

EXAMPLE 2

Brass plating was applied to steel wires of 0.94 mm diameter by a diffusion process under the following conditions.

Plating alloy ratio: 66% of copper and the remainder of zinc
Amount of metal plated: 6.5 g/kg
Diffusion condition: 575° C. for 10 seconds Brass plated wires thus plated were subjected to the process according to the present invention under the following conditions.

Treating liquid: aqueous solution of sulfuric acid
Solution concentration: 20%
Solution temperature: 20° C.
Treating time: 3 seconds Brass plated steel cords with a twisted strand structure of 7 groups, each group having 4 elementary wires of 0.175 mm diameter were prepared by using the brass plated wires thus treated by the process according to the invention and by using the non-treated brass plated wires, and the initial adhesion and the heat-aging resisting adhesion thereof were checked by using the rubber B of Example 1. In the test of the heat-aging resisting adhesion, treatment by heating air for a long period of time was used in addition to the vulcanization for a long period of time.

The results are shown in the following table.

TABLE 5

| | Initial Adhesion and Heat-aging Resisting Adhesion (shown in pull-out force and rubber adhesion rate) | | | | | | | | | |
|---|---|---|---|---|---|---|---|---|---|---|
| | Vulcanizing condition | | | | | | | | | |
| | 160° C. for 20 minutes | | 160° C. for 60 minutes | | 160° C. for 120 minutes | | 160° C. for 20 minutes plus 120° C. for 48 hours | | 160° C. for 20 minutes plus 120° C. for 96 hours | |
| Sample | (kg) | (%) | (kg) | (%) | (kg) | (%) | (kg) | (%) | (kg) | (%) |
| Treated goods | 118 | 95 | 91 | 95 | 82 | 85 | 95 | 95 | 86 | 90 |
| Non-treated goods | 103 | 95 | 83 | 70 | 65 | 30 | 85 | 75 | 78 | 60 |

Thus, it was confirmed that the goods treated by the process according to the present invention have a highly improved heat-aging resisting adhesion even when the twisted strand construction is changed, in the same manner as in Example 1.

EXAMPLE 3

Brass plating was applied to steel wires of 1.56 mm diameter by a diffusion process under the following conditions.

Plating alloy ratio: five kinds, i.e., 60%, 63%, 66%, 69%, and 72% of copper and the remainder of zinc for each kind Amount of metal plated: 5.5 g/kg, for the five kinds Diffusion condition: 575° C. for 10 seconds, for the five kinds The five kinds of the brass plated wires thus plated were treated by the process according to the present invention under the following conditions.

Treating liquid: aqueous solution of nitric acid

Solution concentration: 10%

Solution temperature: 30° C.

Treating time: 3 seconds

Brass plated steel cords of the 3+6 twisted strand construction of Example 1 were prepared by using the five kinds of the brass plated wires thus treated by the process according to the present invention, and the heat-aging resisting adhesion thereof was checked by using the rubber B of Example 1. The results are shown in FIG. 3.

As can be seen from FIG. 3, the heat-aging resisting adhesion was considerably improved at any of the aforesaid five plating alloy ratios.

EXAMPLE 4

Brass plating was applied to steel wires of 1.56 mm diameter by a diffusion process under the following conditions.

Amount of metal plated: four kinds, i.e., 2.0, 4.0, 6.0, and 8.0 g/kg

Plating alloy ratio: 66% of copper and the remainder of zinc, for the four kinds Diffusion condition: 575° C. for 10 seconds, for the four kinds The four kinds of the brass plated wires thus plated were treated by the process according to the present invention under the following conditions.

Treating liquid: aqueous solution of hydrochlorid acid

Solution concentration: 18%

Treating time: 1 second

Brass plated steel cords of the 3+6 twisted strand construction of Example 1 were prepared by using the four kinds of the brass plated wires thus treated by the process according to the present invention, and the heat-aging resisting adhesion thereof was checked by using the rubber B of Example 1. The results are shown in FIG. 4.

As can be seen from FIG. 4, the heat-aging resisting adhesion was considerably improved at any of the aforesaid four amounts of the plated metal.

EXAMPLE 5

Brass plating was applied to steel wires of 1.56 mm diameter by a diffusion process under the following conditions.

Diffusion conditions: four kinds, i.e.,

525° C. for 10 seconds

550° C. for 10 seconds

575° C. for 10 seconds

600° C. for 10 seconds

Plating alloy ratio: 66% of copper and the remainder of zinc, for the four kinds Amount of metal plated: 5.5 g/kg, for the four kinds The four kinds of the brass plated wires thus plated were treated by the process according to the present invention under the following conditions.

Treating liquid: aqueous solution of sulfuric acid

Solution concentration: 10%

Solution temperature: 40° C.

Treating time: 2 seconds

Brass plated steel cords of the 3+6 twisted strand construction of Example 1 were prepared by using the four kinds of the brass plated wires thus treated by the process according to the present invention, and the heat-aging resisting adhesion thereof was checked by using the rubber B of Example 1. The results are shown in FIG. 5.

As can be seen from FIG. 5, the heat-aging resisting adhesion was considerably improved at any of the aforesaid four diffusion conditions.

EXAMPLE 6

Brass plating was applied to steel wires of 1.56 mm diameter by a diffusion process under the following conditions.

Plating alloy ratio: 67% of copper and the remainder of zinc

Amount of metal plated: 5.7 g/kg

Diffusion condition: 575° for 10 seconds

The brass plated wires thus plated were treated by the process according to the present invention under the following conditions.

Treating liquid: aqueous solution of oxalic acid

Solution concentration: five kinds of 2%, 5%, 10%, 25%, and 30%

Solution temperature: 60° C., for the five kinds

Treating time: 2 seconds, for the five kinds

Brass plated steel cords of the 3+6 twisted strand construction of Example 1 were prepared by using the five kinds of the brass plated wires thus treated by the process according to the present invention, and the initial adhesion and the heat-aging resisting adhesion thereof were checked by using the rubber B of Example 1. In addition, the amount of zinc oxide in the brass plated steel cords were measured by using the aforesaid X-ray diffraction device in the aforesaid manner. The results are shown in the following table.

TABLE 6

| Solution concentration | Initial and Heat-aging Resisting Adhesion (shown in rubber adhesion rate) vulcanized at 160° C. for 20 minutes | vulcanized at 160° C. for 60 minutes | vulcanized at 160° C. for 120 minutes | Peak height (mm) for zinc oxide ZnO (101) |
|---|---|---|---|---|
| 2% | 95% | 95% | 70% | 2.5 |
| 5% | 95% | 95% | 85% | 0.0 |
| 10% | 95% | 95% | 85% | 0.0 |
| 25% | 95% | 95% | 85% | 0.0 |
| 30% | 95% | 95% | 85% | 0.0 |
| non-treated | 95% | 80% | 35% | 6.7 |

As shown in the above Table 6, the heat-aging resisting adhesion was improved with the reduction of the amount of zinc oxide.

EXAMPLE 7

Brass plating was applied to steel wires of three different diameters, of 2.03 mm, 1.56 mm, and 1.30 mm, respectively, by a diffusion process under the following conditions.

| | 2.03 mm dia. | 1.56 mm dia. | 1.30 mm dia. |
|---|---|---|---|
| Plating alloy ratio, Cu | 65% | same as left | same as left |
| Amount of metal plated | 6.5 g/kg | same as left | same as left |
| Diffusion condition | 757° C. for 10 seconds | same as left | same as left |

The brass plated wires thus plated were treated by the process according to the present invention under the following conditions.

Treating liquid: a liquid consisting of
15 g of chromic anhydride,
4.5 g of ammonium sulfate, and
1,500 g of water Solution concentration: a 10% aqueous solution of the aforesaid liquid Solution temperature: 20° C.

Dipping time: 2 seconds

The three kinds of the brass plated wires thus treated by the process according to the present invention and non-treated brass plated wires were drawn from diameters of 2.03 mm, 1.56 mm, and 1.30 mm to diameters of 0.56 mm, 0.38 mm, and 0.31 mm, respectively, so as to prepare brass plated wires of diameters of 0.56 mm, 0.38 mm, and 0.31 mm. The initial adhesion and the heat-aging resisting adhesion of the wires thus prepared were checked by using the rubber B of Example 1. The results are shown in the following table.

TABLE 7

| Diameter | Sample | Initial Adhesion and Heat-aging Resisting Adhesion (shown in pull-out force and rubber adhesion rate) Vulcanizing condition 160° C. for 20 minutes (kg) | (%) | 160° C. for 60 minutes (kg) | (%) | 160° C. for 120 minutes (kg) | (%) |
|---|---|---|---|---|---|---|---|
| | Treated goods | 38.0 | 95 | 33.0 | 90 | 25.5 | 70 |
| 0.56 mm | Non-treated goods | 37.0 | 95 | 30.0 | 65 | 19.5 | 25 |
| 0.38 mm | Treated goods | 28.0 | 95 | 24.5 | 90 | 19.0 | 75 |
| | Non-treated goods | 27.5 | 95 | 22.0 | 70 | 14.5 | 30 |
| 0.31 mm | Treated goods | 24.0 | 95 | 21.0 | 95 | 16.0 | 80 |
| | Non-treated goods | 23.5 | 95 | 19.0 | 70 | 12.5 | 35 |

As can be seen from the above table, the heat-aging resisting adhesion was remarkably improved by the process according to the present invention, regardless of the wire diameter.

As described in the foregoing, according to the present invention, the problem of unsatisfactory heat-aging resisting adhesion of brass plated wires with rubber as an unavoidable shortcoming of conventional diffusion process for plating has been completely solved simply by dissolving and removing oxides formed on the surface of the plated brass during diffusion in a stage of brass plated wires, so that a remarkable improvement of the heat-aging resisting adhesion with rubber can be accomplished by an easy treatment at a low cost while maintaining the high initial adhesion and water-durable adhesivion as advantages of the diffusion process. The process of the invention can be easily incorporated into an actual production line and has an outstanding industrial value. Besides, the process of the invention can be applied not only to the brass plated steel cords, but also to wires made by the diffusion process, such as brass plated steel wires and brass plated steel ribbon wires, regardless of treatments after the regular drawing and the shape of the wire cross sections, so as to effectively improve the reinforcement of rubber goods.

Although the invention has been described with a certain degree of particularlity, it is understood that the present disclosure has been made only by way of example and that numerous changes in details of process and treatment may be resorted to without departing from the scope of the invention as hereinafter claimed.

What is claimed is:

1. A process for making a wire having an improved adhesion with rubber for reinforcing rubber goods comprising the steps of plating copper on the surface of a starting metal wire, plating zinc on said copper plated wire, diffusing said plated metals by heating, after diffusing dissolving and removing by chemical dissolution zinc oxides formed, during said diffusion treatment, on the surface of said zinc diffused copper plated metal wire, and drawing said wire thereafter, the dissolving and removing of said oxides being effective in eliminating detrimental effects of said zinc oxides in adhesion of the wire with rubber.

2. A process as set forth in claim 1, wherein said starting metal wire is a steel wire., the diffusing step comprising diffusing zinc on said copper plated steel wire by heating at a temperature of 525° C. to 650° C.

3. A process as set forth in claim 1, wherein said dissolving and removing oxides are carried out by using an aqueous solution of a compound selected from the group consisting of hydrochloric acid, sulfuric acid, phosphoric acid, chromic anhydride, an inorganic acid dissolving said oxides, formic acid, oxalic acid, citric acid, acetic acid, an organic acid dissolving said oxides, sodium hydroxide, potassium hydroxide, an alkali dissolving said oxides, and a mixture thereof.

4. A process as set forth in claim 3, wherein said aqueous solution contains a salt selected from the group consisting of sodium sulfate, sodium borate, sodium carbonate, potassium chloride, potassium dihydrogen phosphate, ammonium sulfate, and ammonium chloride.

5. A process as set forth in any one of the foregoing claims 1 through 4, wherein said dissolving and removing oxides are carried out at room temperature.

* * * * *